US005281354A

United States Patent [19]

Faber

[11] Patent Number: 5,281,354

[45] Date of Patent: Jan. 25, 1994

[54] LIQUID CLEANSER COMPOSITION

[75] Inventor: Robert D. Faber, Grand Rapids, Mich.

[73] Assignee: Amway Corporation, Ada, Mich.

[21] Appl. No.: 782,043

[22] Filed: Oct. 24, 1991

[51] Int. Cl.[5] ..... C11D 1/18

[52] U.S. Cl. ..... 252/154; 252/153; 252/166; 252/171; 252/DIG. 14

[58] Field of Search ..... 252/153, 154, 166, 171, 252/DIG. 14

[56] References Cited

U.S. PATENT DOCUMENTS

| | | |
|---|---|---|
| 2,710,843 | 6/1955 | Stebleton . |
| 3,149,078 | 9/1964 | Zmoda . |
| 3,210,285 | 10/1965 | Gangwisch . |
| 3,281,367 | 10/1966 | Jones et al. . |
| 3,882,038 | 5/1975 | Clayton et al. . |
| 3,957,695 | 5/1976 | Davies et al. . |
| 4,040,989 | 8/1977 | Renaud et al. . |
| 4,175,062 | 11/1974 | Disch et al. . |
| 4,302,347 | 11/1981 | Straw et al. . |
| 4,371,461 | 2/1983 | Jones et al. . |
| 4,414,128 | 11/1983 | Goffinet . |
| 4,457,856 | 7/1984 | Mitchell et al. . |
| 4,492,646 | 1/1985 | Welch . |
| 4,511,488 | 4/1985 | Matta . |
| 4,678,606 | 7/1987 | Akhter et al. . |
| 4,704,225 | 11/1987 | Stoufer ..... 252/548 |
| 4,758,377 | 7/1988 | Iding . |
| 4,767,563 | 8/1988 | de Buzzaccarini . |
| 4,790,951 | 12/1988 | Frieser et al. . |
| 4,869,842 | 9/1989 | Denis et al. . |

FOREIGN PATENT DOCUMENTS

| | | |
|---|---|---|
| 249140 | 4/1963 | Australia . |
| 0137616 | 4/1985 | European Pat. Off. . |

*Primary Examiner*—Patrick P. Garvin
*Assistant Examiner*—Brent M. Peebles
*Attorney, Agent, or Firm*—Willian, Brinks, Hofer, Gilson & Lione

[57] ABSTRACT

A liquid cleanser composition, particularly for use as a hard surface cleanser that comprises a mixture of from about 0.5% to about 10% of a terpene selected from mono- and sesquiterpenes and mixtures thereof, from about 1% to about 10% of a water miscible solvent, and, from about 1% to about 10% of an amide surfactant. The composition can also contain from about 10% to about 70% of a water-insoluble abrasive.

37 Claims, No Drawings

LIQUID CLEANSER COMPOSITION

BACKGROUND OF THE INVENTION

The present invention relates to a liquid cleanser composition, and in particular, to a liquid cleanser useful as a general household cleaning composition.

Liquid general household cleansing compositions are advantageous because they can be applied directly to surfaces so that a relatively high concentration of cleanser is delivered directly to the soiled area. However, such cleansers suffer from a number of drawbacks which can limit their consumer acceptability. For example, some cleansers suffer from a lack of homogeneity, a lack of clarity, inadequate viscosity, excessive sudsing and poor rinsability.

A cleanser having an inadequate viscosity is not favored by consumers because the cleanser will run down vertical surfaces before the user is able to scrub the surface. In addition, when a cleanser lacks homogeneity, an uneven amount of the active ingredients will be dispensed from the container. Moreover, a cleanser lacking homogeneity is not preferred by consumers because it requires the consumer to shake or mix the components of the cleanser prior to using the cleanser.

Also, in view of consumer preferences, the cleanser may provide some sudsing or foaming. Generally, cleansers contain a variety of synthetic anionic, nonionic, amphoteric or zwitterionic surfactants for use as the primary surfactant ingredient, some of which provide foaming to various degrees. It is sometimes desired, however, to also provide a suds booster such as an amide.

Unexpectedly, it has been found that an amide, incorporated into the composition of the present invention and used as the primary surfactant, results in a cleanser that is comparable to a cleanser containing, as a primary surfactant, well known anionic and nonionic surfactants such as alkyl benzene sulfonates and alkoxylated hydrophobic materials, respectively.

Another drawback to some cleansers is that they do not adequately clean greasy, fatty, oily soils typically found in the household environment. It has been suggested, in U.S. Pat. No. 4,414,128, to incorporate a terpene material into the cleanser to provide improved cleaning performance on the greasy type soils as well as to control suds. One problem with the use of terpenes is that they have low water solubility and are difficult to rinse U.S. Pat. No. 4,414,128 discloses adding a polar solvent, having a solubility in water of less than 10%, to a terpene-containing cleanser to obtain a stable homogeneous fluent liquid.

Surprisingly, it has been found that a stable, rinsable cleanser that overcomes or minimizes the drawbacks of the prior art, without using a polar solvent of low water solubility, can be prepared by combining a terpene with a water-miscible solvent. In addition, the cleanser may also contain an amide surfactant and an ethoxylated alcohol that has a relatively low HLB, both of which are known to be poor rinsing. Unexpectedly, however, it has been found that an effective and rinsable cleanser can be prepared even though these individual ingredients are known to exhibit poor rinsing characteristics.

Moreover, the cleanser can incorporate an insoluble abrasive to improve hard surface cleaning while overcoming the drawbacks of prior art abrasive containing cleansers. The present cleanser overcomes known problems associated with the use of abrasives such as phase instability, including layering and settling of the abrasive, and poor rinsability.

The present invention thus provides liquid cleansers which are stable, fluid liquids which provide improved cleaning performance and can optionally contain an abrasive for improved hard surface cleaning performance.

SUMMARY OF THE INVENTION

According to the present invention, a highly rinsable liquid cleanser composition is provided; incorporating three essential ingredients: a terpene, a water-miscible solvent, and an amide surfactant.

In one embodiment, the composition is a clear microemulsion that is stable over a broad temperature range. The composition includes a terpene, which comprises from about 0.5% to about 10% by weight of the composition. (Unless otherwise stated, all percentages set forth herein are by weight.) Terpenes falling within the scope of the invention are those selected from monoterpenes, sesquiterpenes, and mixtures thereof. The water-miscible solvent is present in an amount from about 1% to about 10% by weight of the composition. The amide surfactant is present in an amount from about 1% to about 10% by weight of the composition.

According to another embodiment, the present invention provides a stable liquid cleanser composition which further comprises a water-insoluble abrasive in an amount from about 10% to about 70% by weight of the composition.

DETAILED DESCRIPTION OF THE INVENTION AND PREFERRED EMBODIMENTS

In one embodiment, the cleanser composition incorporates a terpene, a water-miscible solvent, and an amide surfactant. In another embodiment, the cleanser composition further includes a water-insoluble abrasive. Although the cleanser of this embodiment contains the same terpene, water-miscible solvent, and amide surfactant, they are present in amounts which are slightly lower as compared to a cleanser composition not employing an abrasive.

The terpenes useful in the present invention are terpene hydrocarbons, terpene alcohols, and mixtures thereof. As used herein, the term "terpenes" refers to monoterpenes, sesquiterpenes, the alcohol derivatives thereof, and mixtures thereof. The terpenes can be acyclic, monocyclic, or bicyclic, with the monocyclic and bicyclic terpenes being preferred.

Terpene hydrocarbons useful in the present invention are monocyclic terpene hydrocarbons such as the terpinene, terpinolene, and limonene classes, and mixtures thereof, some of which have germicidal effects. In particular, the alpha, beta, and gamma terpinenes, limonene, and dipentene can be used in the present invention. Bicyclic terpene hydrocarbons may also be used and include alpha- and beta-pinene. Most preferably, d-limonene is used.

The terpene hydrocarbon is present at a level of about 0.5% to about 10%, preferably from about 1% to about 5%. More preferably, the terpene hydrocarbon is present at a level from about 2% to about 4%. When no terpene is present, it has been found that the cleaning performance of the cleanser is relatively poor as compared to a cleanser containing a terpene.

When the composition contains an abrasive, the terpene hydrocarbon is present at a level of about 0.5% to about 10%, preferably from about 1% to about 5%. More preferably, the terpene hydrocarbon is present at a level of about 1% to about 3%.

The terpene alcohol can be a primary, secondary, or tertiary alcohol derivative of an acyclic or cyclic terpene hydrocarbon. Suitable tertiary alcohols include terpineol, and linalool. A suitable secondary alcohol includes borneol while a suitable primary alcohol includes geraniol. In addition, complex mixtures of terpene alcohols can be used, especially the mixtures obtained by distilling the oils extracted from pine wood, cones, and needles, which is sold commercially as "pine oil."

Generally, the terpene alcohol is present in the range from about 0.5% to about 10% and can be incorporated at the same level as the terpenes.

The water-miscible solvent useful in the present invention can be selected from aliphatic alcohols, glycol ethers, and mixtures thereof. Examples of alcohols useful in the present invention are the lower $C-C_8$ mono-, di-, and tri-alcohols, such as ethanol, propanol, isopropanol, and propane-1,3-diol.

Suitable glycol ethers are the alkylene and dialkylene glycol mono-$C_1-C_4$ alkyl ethers where the alkylene group is preferably ethylene or propylene and the dialkylene group is preferably diethylene or dipropylene. Most preferably, dipropylene glycol monomethyl ether is used.

Generally, the water-miscible solvent can be added in amounts ranging from about 1% to about 10%, preferably from about 4% to about 8%. More preferably, the water-miscible solvent is added in an amount of about 6% to about 8%. If the solvent is not incorporated into the cleanser, the other ingredients may separate and the result will be a two phase composition.

When an abrasive is present, the water-miscible solvent can be added in amounts ranging from about 1% to about 10%, preferably from about 3% to about 7%. More preferably, the water-miscible solvent is added in an amount of about 4% to about 6%.

A notable feature of the present invention is the effectiveness of the amide surfactant as the sole or primary cleaning surfactant in the composition. Generally, amides have been considered as suds boosters to be used to supplement a variety of surfactants such as anionic, nonionic, amphoteric, and zwitterionic surfactants. It has been found, however, that the amide surfactant in the present invention, used as the primary surfactant, surprisingly provides a cleaning performance comparable to a cleanser using well-known anionic and nonionic surfactants as the primary surfactant.

While the amide may be present as the primary surfactant, its presence also aids in the incorporation of a number of ingredients useful for formulating a cleanser with good cleaning performance. In particular, the amide aids in maintaining the terpene and other optional ingredients, such as a sodium carbonate builder, in a stable microemulsion.

The amide surfactant used in the present invention includes the ammonia and the $C_2-C_4$ alkanol amides of fatty acids having an acyl moiety of from about 8 to about 18 carbon atoms. These acyl moieties may be derived not only from naturally occurring glycerides, e.g. coconut oil, palm oil, soybean oil and tallow, but also can be derived synthetically, e.g. by the oxidation of petroleum or by the hydrogenation of carbon monoxide by the Fischer-Tropsch process. The monoethanol and diethanol amides of $C_{10}-C_{14}$ fatty acids are preferred. The diethanolamide of coconut oil is most preferred.

Generally, the amide surfactant can be added in amounts ranging from about 1% to about 10%, preferably from about 1% to about 5%. More preferably, the amide surfactant is added in an amount of about 2% to about 4%.

When an abrasive is present the amide surfactant can be added in amounts ranging from about 1% to about 10%, preferably from about 1% to about 5%. More preferably, the amide surfactant is added in an amount of about 1% to about 3%.

Water, fragrance and minor components comprise the balance of the cleanser. Preferably, softened or deionized water is used.

In one preferred form of the invention, a water-insoluble abrasive is added for use as a hard surface cleanser. The insoluble abrasive is present in an amount from about 10% to about 70% by weight of the composition. Preferably, the abrasive is present in an amount from about 20% to about 50%. More preferably, the abrasive is included in an amount of about 25% to about 35%.

Suitable abrasives are selected from water-insoluble materials well-known in the art for their relatively mild abrasive properties. Preferably, the abrasives are not excessively harsh or scratching. Suitable abrasives typically have a Mohs hardness in the range of about 1 to about 7, with those having a Mohs hardness in the range of about 2 to about 4 being preferred. Examples of suitable inorganic abrasives include calcium carbonate (calcite), calcium sulfate, dolomite, diatomaceous earth, Fuller's earth, magnesium carbonate, China clay, attapulgite, calcium hydroxyapatite, calcium orthophosphate, and the like, as well as any other water-insoluble mineral salt, within the preferred hardness range.

Preferably, calcium carbonate having a particle size of up to about 1000 microns is used. More preferably, the calcium carbonate has a particle size up to about 60 microns.

Organic abrasives such as urea-formaldehyde, methyl methacrylate, and melamine formaldehyde resins, polyethylene spheres, and polyvinylchloride ("PVC") can also be used.

The compositions of the invention can be supplemented with a secondary surfactant. The secondary surfactant can be selected from a wide range of anionic, nonionic, ampholytic, and zwitterionic surfactants. These surfactants can be used singly or in combination in amounts of up to about 10%, preferably about 0.5% to about 5%, by weight of the composition.

Suitable anionic surfactants are the water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, and alkyl phenol polyethoxy ether sulfates.

A preferred class of anionic surfactants includes the water-soluble salts, particularly the alkali metal, ammonium, and alkanolammonium salts of organic compounds containing sulfur and having in their molecular structure an alkyl or alkaryl group containing from about 8 to about 22, especially from about 10 to about 20 carbon atoms and a sulfonic acid or sulfuric acid ester group. Examples of this class of surfactants are the sodium and potassium alkyl sulfates, especially the sulfates of the higher ($C_8$–$C_{18}$) alcohols, and the sodium and potassium alkyl benzene sulfonates in which the alkyl group contains from about 9 to about 15, preferably about 11 to about 13, carbon atoms.

Suitable nonionic surfactants are the condensation products of alkylene oxide groups with an organic hydrophobic compound, which can be aliphatic or an alkyl aromatic. One example of such a nonionic surfactant is the condensation product of one mole of an alkyl phenol having an alkyl group containing from 6 to 12 carbon atoms with from about 5 to about 25 moles of ethylene oxide.

A preferred nonionic surfactant is the condensation product of one mole of an aliphatic alcohol having from 8 to 18 carbon atoms with from 1 to about 10 moles of alkylene oxide. Such a condensation product preferably has a hydrophile-lipophile balance ("HLB") in the range of 9–13 with an HLB of about 11 being particularly preferred.

More preferably, the aliphatic alcohol is a linear $C_6$–$C_{16}$ alcohol which is ethoxylated with between 2 and 7 moles of ethylene oxide per mole of alcohol. Most preferably, the aliphatic alcohol is a $C_{11}$ alcohol and is ethoxylated with an average of about 5 moles of ethylene oxide per mole of alcohol. A specific example of such a nonionic surfactant is Neodol 1–5 which has an HLB of 11.2 (Neodol is a trade name of Shell Chemical Co.).

Generally, the nonionic surfactant may be present at a level up to about 10% preferably in the range from about 0.5% to about 5%. More preferably, the amount of nonionic surfactant is in the range from about 1% to about 4%.

When an abrasive is present, the nonionic surfactant may be present at a level up to about 10% preferably in the range from about 0.5% to about 5%. More preferably, the amount of nonionic surfactant is in the range from about 0.5% to about 3%.

Suitable semi-polar surfactants are water-soluble amine oxides containing one alkyl moiety of from about 10 to 28 carbon atoms and two moieties selected from the groups consisting of alkyl groups and hydroxyalkyl groups containing from about 1 to about 3 carbon atoms. Preferably the semi-polar surfactant is an alkyl dimethylamine oxide wherein the alkyl group contains from about 10 to 16 carbon atoms. Suitable ampholytic surfactants are the water-soluble derivatives of aliphatic secondary and tertiary amines where one of the aliphatic substituents contains from about 8 to about 18 carbon atoms and one contains an anionic water-solubilizing group such as carboxyl, sulfonate, sulfate, phosphate, or phosphonate.

Suitable zwitterionic surfactants are water-soluble derivatives of aliphatic quaternary ammonium, phosphonium, and sulfonium cationic compounds where one of the aliphatic substituents contains from about 8 to 18 carbon atoms and one contains an anionic water-solubilizing group.

The cleanser composition of the invention may also contain thickeners. When there is no abrasive present, the thickener provides "clinging" character by producing pseudoplastic behavior. When an abrasive is present, the thickener increases the viscosity and the yield point of the composition to aid in suspending the abrasive. However, as is well known in the art, high levels of thickeners can be detrimental to the overall performance of the cleanser because they render it difficult to rinse from cleaned surfaces. In addition, an excessive amount of a thickener will cause the composition to gel. Accordingly, the amount of thickener should preferably not exceed about 3%, and preferably be added up to about 2%. Most preferably, the thickener is present in the range of from about 0.5% to about 1.5%.

Any of the common thickeners such as clays, polyacrylates, polycellulose materials, carboxymethyl celluloses, alginates, and xanthan gum can be used. The selection of a suitable thickener is well within the ability of one skilled in the art. A particularly suitable thickener for use in the composition of the present invention is Kelzan-AR, a xanthan gum from Kelco Co.

Since the cleansing composition exists in the liquid form, it can preferably contain stabilizing agents such as certain hydrotropes to promote phase stability. Commonly employed hydrotropes include lower alkylaryl sulfonates such as sodium and potassium toluene sulfonate, xylene sulfonate, benzene sulfonate, and cumene sulfonate. The term "sulfonate" as used herein refers to the mono-sulfonate, di-sulfonate, and mixtures thereof.

A particularly preferred hydrotrope useful in the present invention is a lower paraffin sulfonate containing up to about 10 carbon atoms. Most preferably, the hydrotrope is sodium octyl sulfonate, which is sold under the trade name PAS-8S by Stepan Chemical Co., and is stated to contain about 32% active ingredient.

Generally, the hydrotrope may be present at a level up to about 10% by weight of the composition. The amount of hydrotrope added is preferably in the range from about 0.5% to about 5%, more preferably from about 1% to about 3%.

When an abrasive is employed, the hydrotrope may be present at a level up to about 10% by weight of the composition. The amount of hydrotrope added is preferably in the range from about 0.5% to about 5%, more preferably from about 1% to about 2%.

The cleansing compositions can also contain other ingredients which may further enhance their cleaning performance and are compatible with the composition of the present invention. For example, the composition can contain builders and sequestrants. Well known builders and sequestrants include the conventional inorganic water-soluble builder salts such as water-soluble salts of phosphates, pyrophosphates, orthophosphates, polyphosphates, tripolyphosphates, silicates, carbonates, bicarbonates, borates, sulfates, citrates and the like. Particularly preferred are the alkali metal, for example, sodium and potassium, carbonates, bicarbonates and silicates. Most preferably, sodium carbonate is used. Organic builders may also be used, and include water-soluble phosphonates, polyphosphonates, amino-polyphosphonates, polyhydroxysulphonates, polyacetates, aminopolyacetates, carboxylates, polycarboxylates, succinates, and the like. Such builders and sequestrants can be present at levels up to about 10%. More preferably they are present at levels up to about 7%, particularly from about 1% to about 5%.

Perfumes and fragrances, which are conventional in the art, may be added in amounts up to about 1%. Dyes may also be added in an amount sufficient to impart a predetermined color to the cleanser composition.

When an abrasive is included, the proportions of the various ingredients of the composition are adjusted to provide an appropriate viscosity for suspending ability and consumer acceptability.

EXAMPLES

The following examples are provided by way of explanation and description and should not be seen as limiting the scope of the invention.

In the examples that follow, the abbreviations used have the following descriptions.

| | |
|---|---|
| DPM | Dipropylene glycol monomethyl ether marketed by Dow Chemical under the Trade name Dowanol DPM. |
| Kelzan AR | A modified xanthan gum marketed by Kelco. |
| PAS-8S | A 32% active ingredient solution of sodium octyl sulfonate marketed by Stepan Chemical Co. |
| Ninol 11-CM | An alkaline-stable (i.e. 2:1 type) coconut diethanolamide marketed by Stepan Chemical Co. |
| Neodol 1-5 | A $C_{11}$ alcohol ethoxylated with an average of 5 moles of ethylene oxide marketed by Shell Chemical Co. |
| Monateric 1188M | A 30% active ingredient solution of disodium lauryl β-iminodipropionate marketed by Mona Industries. |
| Monateric CEM-38 | A 38% active ingredient solution of cocamidopropionate, an imidazoline-type zwitterionic surfactant marketed by Mona Industries. |

EXAMPLES 1 TO 8

The following liquid compositions were prepared by mixing the following ingredients in water:

| | EXAMPLES 1 TO 8 (% by weight) | | | | | | | |
|---|---|---|---|---|---|---|---|---|
| COMPONENT | 1 | 2 | 3 | 4 | 5 | 6 | 7 | 8 |
| D-limonene | 2.0 | — | 2.0 | 2.0 | 2.0 | 2.0 | 2.0 | 2.0 |
| DPM | 5.0 | 5.0 | 5.0 | 5.0 | 5.0 | 5.0 | 5.0 | 5.0 |
| Ninol 11-CM | 2.0 | 2.0 | 2.0 | 1.0 | 3.0 | 2.0 | 2.0 | — |
| Calcium carbonate | 30.0 | 30.0 | 30.0 | 30.0 | 30.0 | 30.0 | 30.0 | 30.0 |
| Neodol 1-5 | 1.0 | 1.0 | 1.0 | 2.0 | — | 1.0 | 1.0 | 2.0 |
| Monateric 1188M | — | — | — | — | — | — | 3.0 | — |
| PAS-8S | 3.0 | 3.0 | 3.0 | 3.0 | 4.0 | 4.0 | — | 4.0 |
| Kelzan-AR | 1.0 | 1.0 | 1.0 | 1.0 | 1.0 | 1.0 | 0.8 | 1.0 |
| Sodium carbonate | 2.5 | 2.5 | 2.5 | 2.5 | 2.5 | 2.5 | 2.5 | 2.5 |
| Sodium citrate | — | — | 3.0 | — | — | — | 1.5 | 3.0 |
| Water, fragrance and minor components | q.s. to 100 | | | | | | | |

The above compositions were homogeneous, flowable liquids possessing good stability and good to excellent cleaning performance. Cleaning evaluations were conducted according to ASTM D4488.

Compositions 1 through 6 were evaluated for cleaning performance for removal of Shell-type oily soil. It was found that all compositions performed very well except Ex. 2, which did not contain d-limonene. Also, the following relative performance observations were made: Ex. 3 performed the best, with Examples 6, 1, 4, and 5 performing about the same, in that order, and all performed significantly better than Ex. 2.

Compositions 1 through 6 were also evaluated for cleaning performance for removal of Sebum-Lampblack soil. The following relative performance observations were made: Ex. 3 performed the best with Exs. 1 and 5 performing about the same as Ex. 3, and both performing slightly better than Ex. 6 which performed slightly better than Ex. 4 which performed much better than Ex. 2.

Compositions 1, 3, and 5–8 were evaluated for cleaning performance for removal of soap scum. It was observed that Ex. 5, which contained an amide as the sole surfactant, performed about equally as well as Ex. 8, which did not contain an amide but contained a well known nonionic surfactant. The following relative performance observations were made: Ex. 5 performed the best with Exs. 8, 1, 3, 7, and 6 performing about the same as Ex. 5, in that order.

EXAMPLES 9 TO 12

The following liquid compositions were prepared by mixing the following ingredients in water:

| | (% by weight) | | | |
|---|---|---|---|---|
| COMPONENT | 9 | 10 | 11 | 12 |
| D-limonene | 2.9 | 2.9 | 2.9 | 2.9 |
| DPM | 7.3 | 7.3 | 7.3 | 7.3 |
| Ninol 11-CM | 2.9 | 2.9 | 2.9 | 2.9 |
| Neodol 1-5 | 1.4 | 1.4 | 1.4 | 1.4 |
| Monateric 1188M | — | — | 2.9 | — |
| Monateric CEM-38 | — | — | — | 4.3 |
| PAS-8S | 4.3 | 5.8 | 2.9 | — |
| Sodium carbonate | 3.6 | 3.6 | 3.6 | 3.6 |
| Sodium citrate | — | — | 2.2 | — |
| Water, fragrance and minor components | q.s. to 100 | | | |

The above compositions were homogeneous, single-phase, flowable liquids possessing excellent stability over wide temperature ranges. Example 9 showed no phase separation up to 142° F. while Exs. 10, 11, and 12 remained homogeneous to over 160° F., even though the amount of active hydrotrope was low.

Of course, it should be understood that a wide range of changes and modifications can be made to the embodiments described above. It is therefore intended that the foregoing description illustrates rather than limits this invention, and that it is the following claims, including all equivalents, which define this invention.

I claim:

1. A stable liquid microemulsion cleanser composition comprising:

a. from about 0.5% to about 10% of a terpene selected from mono- and sesquiterpenes and mixtures thereof;

b. from about 1% to about 10% of a water-miscible solvent;

c. from about 1% to about 10% of an amide surfactant; and, d. water forming the balance.

2. The cleanser composition of claim 1 wherein the terpene is selected from the group consisting of terpinenes, terpinolenes, limonenes, pinenes, and mixtures thereof.

3. The cleanser composition of claim 1 wherein the water-miscible solvent is a glycol ether.

4. The cleanser composition of claim 1 wherein the amide surfactant is selected from the group consisting of $C_2$–$C_4$ alkanolamides of $C_8$–$C_{18}$ fatty acids, and mixtures thereof.

5. The cleanser composition of claim 1 further comprising up to about 10% of a secondary surfactant selected from the group consisting of anionic, nonionic, zwitterionic, and ampholytic surfactants and mixtures thereof.

6. A stable liquid microemulsion cleanser composition comprising:

a. from about 1% to about 5% of a terpene selected from mono- and sesquiterpenes and mixtures thereof;

b. from about 4% to about 8% of a water-miscible solvent;

c. from about 1% to about 5% of an amide surfactant; and, d. water forming the balance.

7. The cleanser composition of claim 6 wherein the terpene is selected from the group consisting of terpinenes, terpinolenes, limonenes, pinenes, and mixtures thereof.

8. The cleanser composition of claim 7 wherein the terpene is d-limonene.

9. The cleanser composition of claim 6 wherein the water-miscible solvent is a glycol ether.

10. The cleanser composition of claim 9 wherein the glycol ether is dipropylene glycol monomethyl ether.

11. The cleanser composition of claim 6 wherein the amide surfactant is selected from the group consisting of $C_2C_4$ alkanolamides of $C_8$–$C_{18}$ fatty acids, and mixtures thereof.

12. The cleanser composition of claim 11 wherein the amide surfactant is selected from the group consisting of monoethanolamides and diethanolamides of $C_{10}$–$C_{14}$ fatty acids, and mixtures thereof.

13. The cleanser composition of claim 6 further comprising from about 0.5% to about 5% of a secondary surfactant comprising an ethoxylated alcohol that is the condensation product of one mole of an aliphatic alcohol, having from about 6 to about 16 carbon atoms, with from about 2 to about 7 moles of ethylene oxide.

14. The cleanser composition of claim 6 further comprising up to about 10% of a hydrotrope.

15. A liquid microemulsion cleanser composition comprising:

a. from about 2% to about 4% of d-limonene;

b. from about 6% to about 8% of dipropylene glycol monomethyl ether;

c. from about 2% to about 4% of diethanolamide of coconut oil;

d. up to about 10% of a hydrotrope;

e. from about 0.5% to about 5% of a secondary surfactant comprising an ethoxylated alcohol having from about 6 to about 16 carbon atoms and from about 2 to about 7 ethylene oxide groups per molecule;

f. up to about 10% of a builder; and, g. water, forming the balance of the composition.

16. A stable liquid cleanser composition comprising:

a. from about 0.5% to about 10% of a terpene selected from mono-and sesquiterpenes and mixtures thereof;

b. from about 1% to about 10% of a water-miscible solvent;

c. from about 1% to about 10% of an amide surfactant;

d. from about 10% to about 70% of a water insoluble abrasive; and, e. water forming the balance.

17. The cleanser composition of claim 16 wherein the terpene is selected from the group consisting of terpinenes, terpinolenes, limonenes, pinenes, and mixtures thereof.

18. The cleanser composition of claim 16 wherein the water-miscible solvent is a glycol ether.

19. The cleanser composition of claim 16 wherein the amide surfactant is selected from the group consisting of $C_2$–$C_4$ alkanolamides of $C_8$–$C_{18}$ fatty acids, and mixtures thereof.

20. The cleanser composition of claim 16 further comprising up to about 10% of a secondary surfactant selected from the group consisting of anionic, nonionic, zwitterionic, and ampholytic surfactants and mixtures thereof.

21. The cleanser composition of claim 16 wherein the water insoluble abrasive is calcium carbonate.

22. The cleanser composition of claim 16 further comprising up to about 3% of a thickener.

23. A stable liquid cleanser composition comprising:

a. from about 1% to about 5% of a terpene selected from mono- and sesquiterpenes and mixtures thereof;

b. from about 3% to about 7% of a water-miscible solvent;

c. from about 1% to about 5% of an amide surfactant;

d. from about 20% to about 50% of a water insoluble abrasive; and, e. water forming the balance.

24. The cleanser composition of claim 23 wherein the terpene is selected from the group consisting of terpinenes, terpinolenes, limonenes, pinenes, and mixtures thereof.

25. The cleanser composition of claim 24 wherein the terpene is d-limonene.

26. The cleanser composition of claim 23 wherein the water-miscible solvent is a glycol ether.

27. The cleanser composition of claim 23 wherein the water-miscible solvent is dipropylene glycol monomethyl ether.

28. The cleanser composition of claim 23 wherein the amide surfactant is selected from the group consisting of $C_2$–$C_4$ alkanolamides of $C_8$–$C_{18}$ fatty acids, and mixtures thereof.

29. The cleanser composition of claim 28 wherein the amide surfactant is selected from the group consisting of monoethanolamides and diethanolamides of $C_{10}$–$C_{14}$ fatty acids, and mixtures thereof.

30. The cleanser composition of claim 23 further comprising from about 0.5% to about 5% of a secondary surfactant selected from the group consisting of anionic, nonionic, zwitterionic, and ampholytic surfactants and mixtures thereof.

31. The cleanser composition of claim 23 further comprising from about 0.5% to about 5% of a secondary surfactant comprising an ethoxylated alcohol that is the condensation product of one mole of an aliphatic alcohol, having from about 6 to about 16 carbon atoms, with from about 2 to about 7 moles of ethylene oxide.

32. The cleanser composition of claim 23 further comprising up to about 10% of a hydrotrope.

33. The cleanser composition of claim 32 wherein the hydrotrope is a lower paraffin sulfonate.

34. The cleanser composition of claim 23 wherein the water insoluble abrasive is calcium carbonate.

35. The cleanser composition of claim 23 further comprising up to about 2% of a thickener.

36. The cleanser composition of claim 35 wherein the thickener is xanthan gum.

37. A liquid abrasive cleanser composition comprising:

a. from about 1% to about 3% percent of d-limonene;

b. from about 4% to about 6% of dipropylene glycol monomethyl ether;

c. from about 1% to about 3% of diethanolamide of coconut oil;

d. from about 25% to about 35% percent of a water insoluble abrasive;

e. from about 1% to about 3% of a hydrotrope;

f. from about 0.5% to about 3% of an ethoxylated alcohol having from about 6 to about 16 carbon atoms and from about 2 to about 7 ethylene oxide groups per molecule;

g. from about 0 5% to about 1.5% of a thickener;

h. from about 1% to about 5% of a builder; and, i. water, forming the balance of the composition.

* * * * *

UNITED STATES PATENT AND TRADEMARK OFFICE

CERTIFICATE OF CORRECTION

PATENT NO. : 5,281,354
DATED : January 25, 1994
INVENTOR(S) : Robert D. Faber

It is certified that error appears in the above-indentified patent and that said Letters Patent is hereby corrected as shown below:

In Column 1, line 49, after the word "rinse" insert -- . --.

In column 3, line 22, delete "C" and insert -- $C_1$ -- therefor.

Signed and Sealed this
First Day of November, 1994

*Attest:*

*Attesting Officer*

BRUCE LEHMAN

*Commissioner of Patents and Trademarks*